US005184966A

United States Patent [19]

Kobayashi et al.

[11] Patent Number: 5,184,966

[45] Date of Patent: Feb. 9, 1993

[54] ADJUSTABLE JET PROPULSION UNIT FOR WATERCRAFT

[75] Inventors: Noboru Kobayashi; Yoshiki Futaki, both of Iwata, Japan

[73] Assignee: Yamaha Hatsudoki Kabushiki Kaisha, Iwata, Japan

[21] Appl. No.: 734,491

[22] Filed: Jul. 23, 1991

[30] Foreign Application Priority Data

Jul. 23, 1990 [JP] Japan ..... 2-195408

[51] Int. Cl.[5] ..... B63H 11/01; B63H 11/11; B63H 11/113

[52] U.S. Cl. ..... 440/38; 60/221; 440/41; 440/42; 440/46

[58] Field of Search ..... 114/38, 40–43, 114/46, 47; 60/221, 222

[56] References Cited

U.S. PATENT DOCUMENTS

| | | | |
|---|---|---|---|
| 3,064,616 | 11/1962 | Dowty | 440/46 X |
| 3,207,116 | 9/1965 | France | 440/41 |
| 3,461,831 | 8/1969 | Lewis | 440/41 |
| 4,437,841 | 3/1984 | Stallman | 440/38 X |
| 4,597,742 | 7/1986 | Finkl | 440/61 |

FOREIGN PATENT DOCUMENTS

| | | | |
|---|---|---|---|
| 4732761 | 2/1979 | Fed. Rep. of Germany . | |
| 386760 | 9/1990 | Japan | 440/42 |
| 2032871 | 5/1980 | United Kingdom | 440/38 |

*Primary Examiner*—Sherman Basinger
*Attorney, Agent, or Firm*—Ernest A. Beutler

[57] ABSTRACT

A jet propelled watercraft that is pivotal about a transversely extending horizontally disposed axis for raising the jet propulsion unit from the body of water in which it is operating and also for trim adjustment of the jet propulsion unit. A trim plate is affixed to the under side of the jet propulsion unit and spans a pair of side walls defining the tunnel opening in which the jet propulsion unit is received for providing trim adjustment of the watercraft upon trim movement of the jet propulsion unit. Sealing arrangements are disclosed for providing sealing around the jet propulsion unit water inlet opening during the trim adjustment.

19 Claims, 7 Drawing Sheets

ADJUSTABLE JET PROPULSION UNIT FOR WATERCRAFT

BACKGROUND OF THE INVENTION

This invention relates to an adjustable jet propulsion unit for a watercraft and more particularly to an improved arrangement for adjusting the position of a jet propulsion unit in a watercraft, supporting the jet propulsion for its movement and effective operation of the jet propulsion unit regardless of its position and also for adjusting the trim of a jet propelled watercraft.

Jet propulsion units have been proposed for powering watercraft and have a number of well known advantages. When the jet propulsion unit is mounted within a tunnel in the underside of the watercraft, a very good looking craft results. However, the positioning of the jet propulsion unit in the tunnel gives rise to certain servicing difficulties. In addition, it is desirable to insure that the jet propulsion unit may be raised out of the body of water in which the watercraft resides when the jet propulsion unit is not used for propulsion purposes. This will insure against incrustation of the jet propulsion unit and other disadvantages. A variety of devices have been proposed for moving the position of the jet propulsion unit and raising it out of the body of water in which the watercraft is operating when it is not being employed to propel the watercraft.

In addition to the aforenoted feature, it is well known in watercraft to provide some form of trim adjustment to adjust the trim of the watercraft to suit varying purposes. For example, the trim may be adjusted to improve the planing posture of the boat according to the rider's weight and rider's position, to improve posture according to wave condition and boat speed and also to trim for improved straight running or turning operations. Where a jet propulsion unit is used to propel a watercraft and it is movable and also a movable trim adjustment is incorporated, the structure becomes quite complicated and expensive.

It is, therefore, a principal object of this invention to provide an improved jet propelled watercraft having a movable jet propulsion unit and an integral trim adjustment.

It is a further object of this invention to provide a jet propulsion unit for a watercraft that embodies an integral trim adjustment.

If the jet propulsion unit is moved to change the trim condition of the watercraft, certain other problems arise. That is, it is desirable to insure that the water inlet opening of the jet propulsion unit is effectively sealed even when the trim condition is changed. Unless good sealing is provided around the water inlet opening of the jet propulsion unit, poor efficiency may result due to leakage around the water inlet opening.

It is, therefore, a further object of this invention to provide an improved arrangement for a movable jet propulsion unit that will provide good sealing around the water inlet regardless of the trim position of the jet propulsion unit.

When the trim of the jet propulsion unit is changed, there are additional problems in connection with the design. As is well known, jet propelled watercraft are normally steered by employing a pivotally supported steering nozzle at the discharge of the jet propulsion unit. This gives rise to substantial side thrusts on the jet propulsion unit when turning. If a movable support is employed, it must be capable of absorbing these large steering side thrusts.

It is, therefore, a further object of this invention to provide an improved and rigid support for a trim adjusted jet propulsion unit.

It is a further object of this invention to provide an improved side thrust taking arrangement for a movably supported jet propulsion unit.

SUMMARY OF THE INVENTION

A first feature of this invention is adapted to be embodied in a jet propelled watercraft having a hull with a tunnel formed in the underside thereof and defined by a pair of spaced apart side walls. A jet propulsion unit is mounted within the tunnel for pivotal movement about a horizontally extending transverse axis disposed at the forward portion of the jet propulsion unit. In accordance with this feature of the invention, a trim plate is affixed to the under side of the rear of the jet propulsion unit and extends between the side walls for adjusting the trim of the watercraft upon pivotal movement of the jet propulsion unit.

Another feature of the invention is also adapted to be embodied in a jet propelled watercraft having a hull with a tunnel and a pivotally mounted jet propulsion unit as described in the preceding paragraph. In accordance with this feature of the invention, the jet propulsion unit has a downwardly facing water inlet opening and the adjacent portion of the hull is formed with a curved surface that is complementary to the path of movement of the jet propulsion unit during trim adjustment so as to provide a seal between the hull and the water inlet opening of the jet propulsion unit in all of the trim adjusted positions.

A still further feature of the invention is adapted to be embodied in a jet propelled watercraft having a hull and tunnel and pivotally supported jet propulsion unit as described in the preceding paragraphs. In accordance with this feature of the invention, a plate is affixed to the under side of the rear of the jet propulsion unit and has side portions engaged with the side walls of the hull so as to transfer side thrusts from the jet propulsion unit directly to the hull side walls.

DETAILED DESCRIPTION OF THE PREFERRED EMBODIMENT OF THE INVENTION

Figure 1:
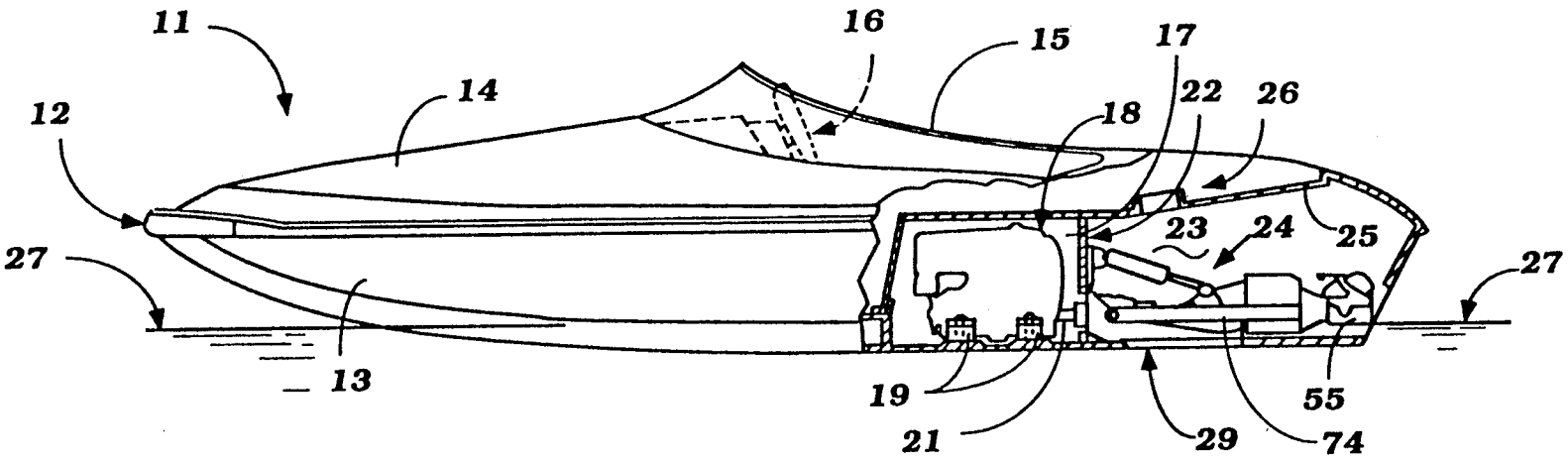
FIG. 1 is a side elevational view of a watercraft powered by a jet propulsion unit constructed in accordance with an embodiment of the invention, with a portion broken away so as to more clearly show certain details of the construction.

Referring first in detail to FIG. 1, a watercraft having a jet propulsion unit constructed and mounted in accordance with an embodiment of the invention is identified generally by the reference numeral 11. The watercraft 11 has a hull, indicated generally by the reference numeral 12 which may have any suitable configuration and which may be comprised of a lower hull portion 13 and a deck portion 14 with these portions being formed from suitable material such as a molded fiberglass reinforced resin. In the illustrated embodiment, the hull 12 is provided with a rearwardly positioned passenger compartment 15 in which a steering wheel 16 and other controls are provided for operating the watercraft 11.

The central rear portion of the lower part of the hull 13 is formed with an engine compartment 17 in which an internal combustion 18 of any known type is mounted on engine supports 19. The engine 18 has its output shaft 21 extending rearwardly through a bulkhead 22 formed forwardly of a tunnel 23 that extends generally along the longitudinal axis of the watercraft and in which a jet propulsion unit, indicated generally be reference numeral 24 is positioned. The tunnel 23 is defined in part by a horizontally extending surface 25 of the hull 12 in which an access opening 26 is provided for a purpose to be described. The watercraft 11 is designed to be operated in a body of water at a normal water level as shown by the line 27 in the certain of the figures.

Figure 2:
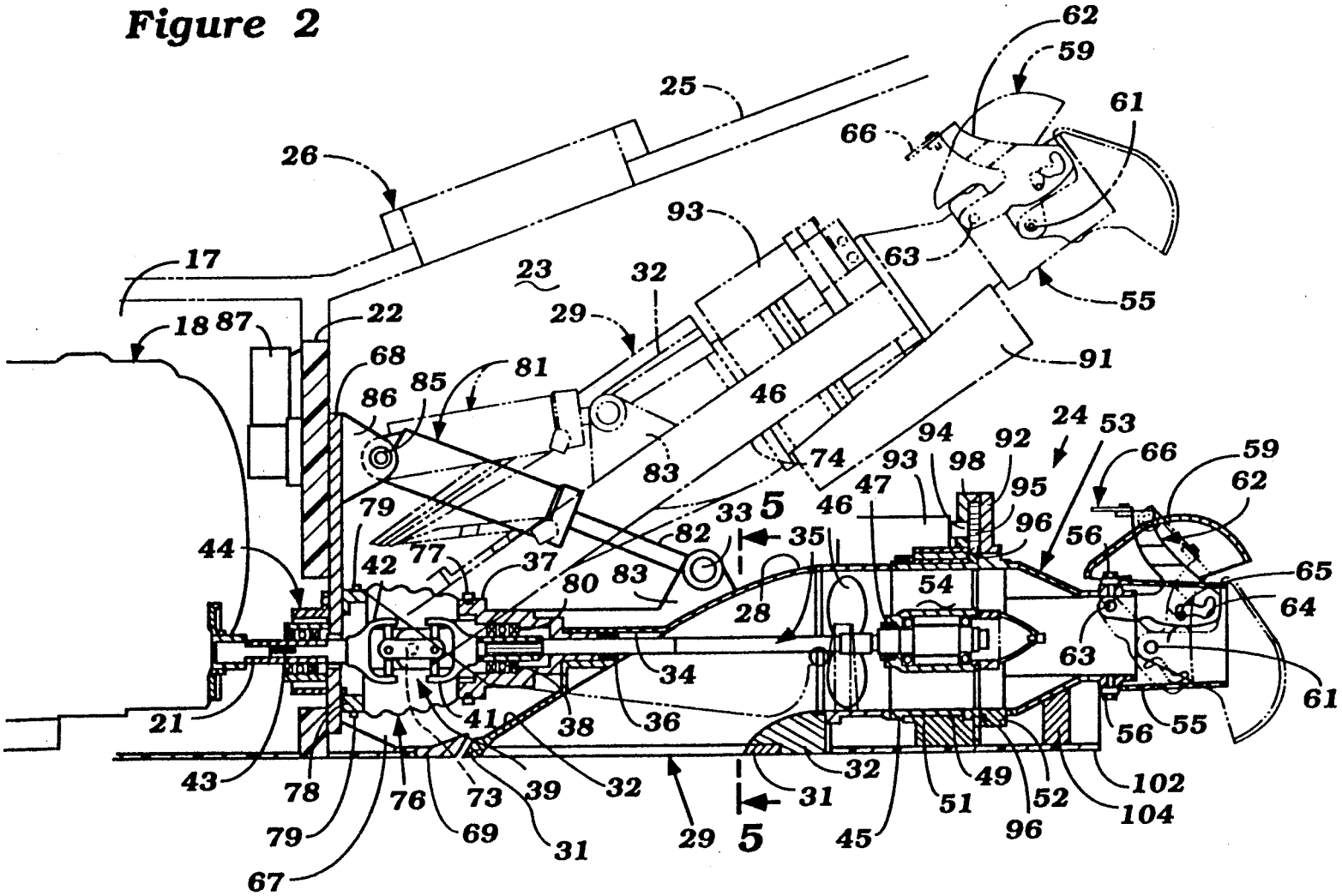
FIG. 2 is an enlarged cross sectional view of the broken away area of FIG. 1 showing the propulsion unit in its normal position in solid lines and in its out of the water servicing position in phantom lines.
Figure 5:
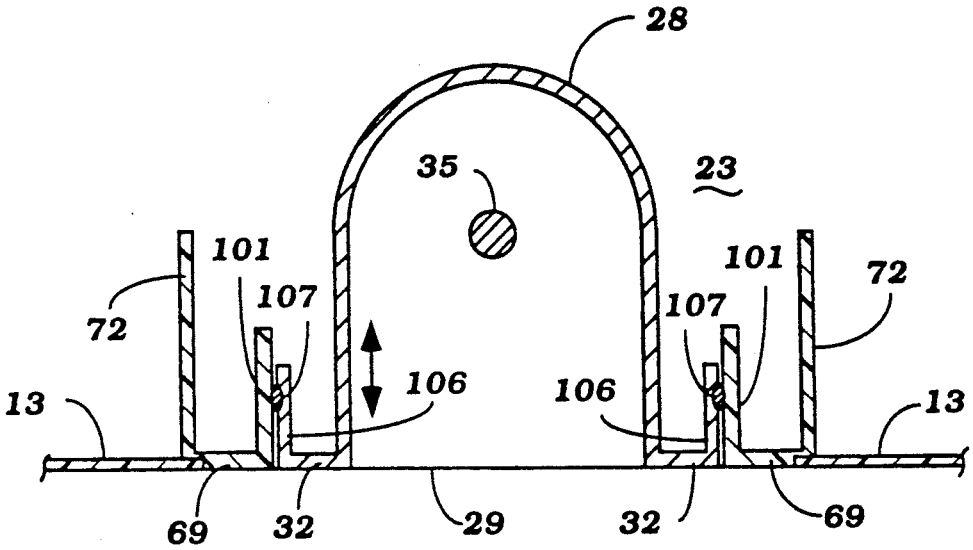
FIG. 5 is an enlarged cross-sectional view taken generally along the line 5—5 of FIG. 2.

Referring now to the remaining figures and initially primarily to FIGS. 2 and 5, the jet propulsion unit 24 includes an outer housing that is comprised of an inlet portion 28 that defines a downwardly facing water inlet opening 29. The inlet opening 29 is defined by a grill like member 31 that is affixed to a housing flange 32 of the housing portion 28 and which also faces downwardly. The flange 32 has generally rectangular configuration. The water inlet portion 28 has a forwardly extending pilot portion 34 that passes an impeller shaft 35. A seal 36 surrounds the impeller shaft 35 within the portion 34 and provides a water seal to preclude water leakage.

The forward end of the housing portion 34 receives a fitting 37 that carries a seal and bearing 38 for journaling the impeller shaft 35 adjacent the forward end thereof. A universal joint, indicated generally by the reference numeral 39 has a yoke portion 41 that has a splined connection to the impeller shaft 35. The yoke portion 41 is, in turn, connected to a further yoke portion 42 that has a splined connection 43 to the engine output shaft 21. This splined connection is contained within a bushing 44 which is mounted in a manner to be described. The aforedescribed connection permits a driving connection between the engine output shaft 21 and the impeller shaft 35 which also permits the jet propulsion unit 24 to be pivoted about a transverse, horizontal axis as defined by the universal joint 39 and a further construction, to be described.

Rearwardly of the inlet portion 28 of the jet propulsion unit outer housing, there is provided an impeller housing, indicated generally by the reference numeral 45 in which an impeller 46 is contained. The impeller 46 is suitably coupled to the impeller shaft 35. The rear end of the impeller shaft 35 is journaled within a bearing assembly 47 that is carried in the impeller housing 45 of the jet propulsion unit housing in a suitable manner. A flange assembly, indicated generally by the reference numeral 48 is provided at the forward portion of the impeller housing 45 for attaching the impeller housing 45 to a corresponding flange of the water inlet portion 28.

The impeller housing 45 is formed with a cylindrical surface that is journaled by means of a bushing 49 within a bearing member 51. The bearing member 51 is, in turn, affixed by means of a coupling plate 52 to a discharge nozzle 53 which also forms a component of the outer housing assembly of the jet propulsion unit 24. The discharge nozzle 53 receives water which has been discharged from the impeller section 45 by the impeller 46 past straightening vanes 54 formed integrally with the impeller housing 45.

A steering nozzle, indicated generally by the reference numeral 55 is supported for steering movement at the discharge end of the discharge nozzle 53 by means of vertically extending pivot pins 56. The steering nozzle 55 has an outwardly extending steering arm (not shown) formed integrally with it to which a bowden wire 58 is affixed by a suitable coupling. The forward end of the bowden wire 58 is connected to the steering wheel 16 in appropriate manner for steering of the watercraft in a manner as is well known with such jet propulsion units.

A reverse thrust bucket 59 has arm portions that are journaled on opposite sides of the steering nozzle 55 by means of pivot pins 61 for movement between a normal forward drive position as shown in solid lines in FIG. 2 and in a reverse thrust position as shown by ..- lines in this same figure. An actuating lever 62 is also pivoted on the steering nozzle 55 by means of pivot pins 63 and has a cam slot 64 that receives pins 65 of the reverse thrust bucket 59. An operating bowden wire 66 is connected to the actuating lever 62 and is operative when pulled to pivot the actuating lever 62 and move the reverse thrust bucket 59 between its forward and reverse positions. The forward end of the bowden wire 66 is connected to an appropriate control positioned in the passenger compartment 15 which control does not appear in the figures.

Figure 3:
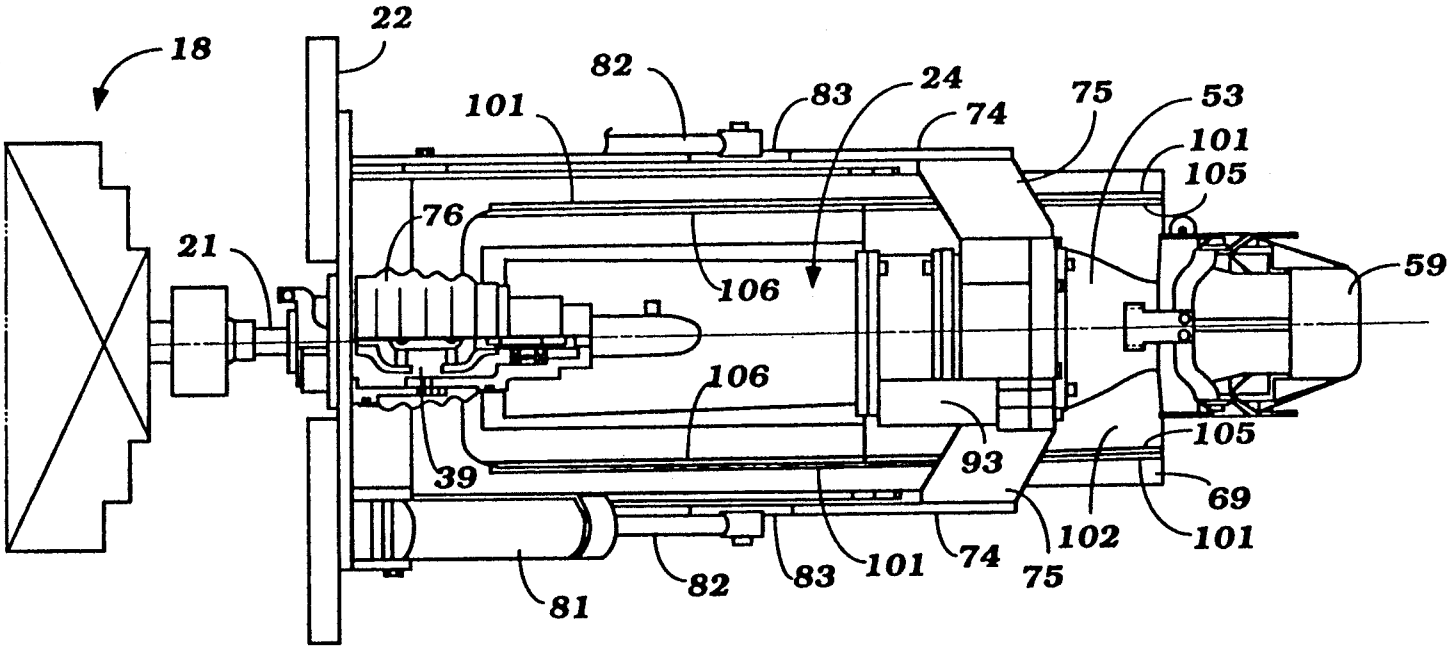
FIG. 3 is a top plan view of the jet propulsion unit.
Figure 4:
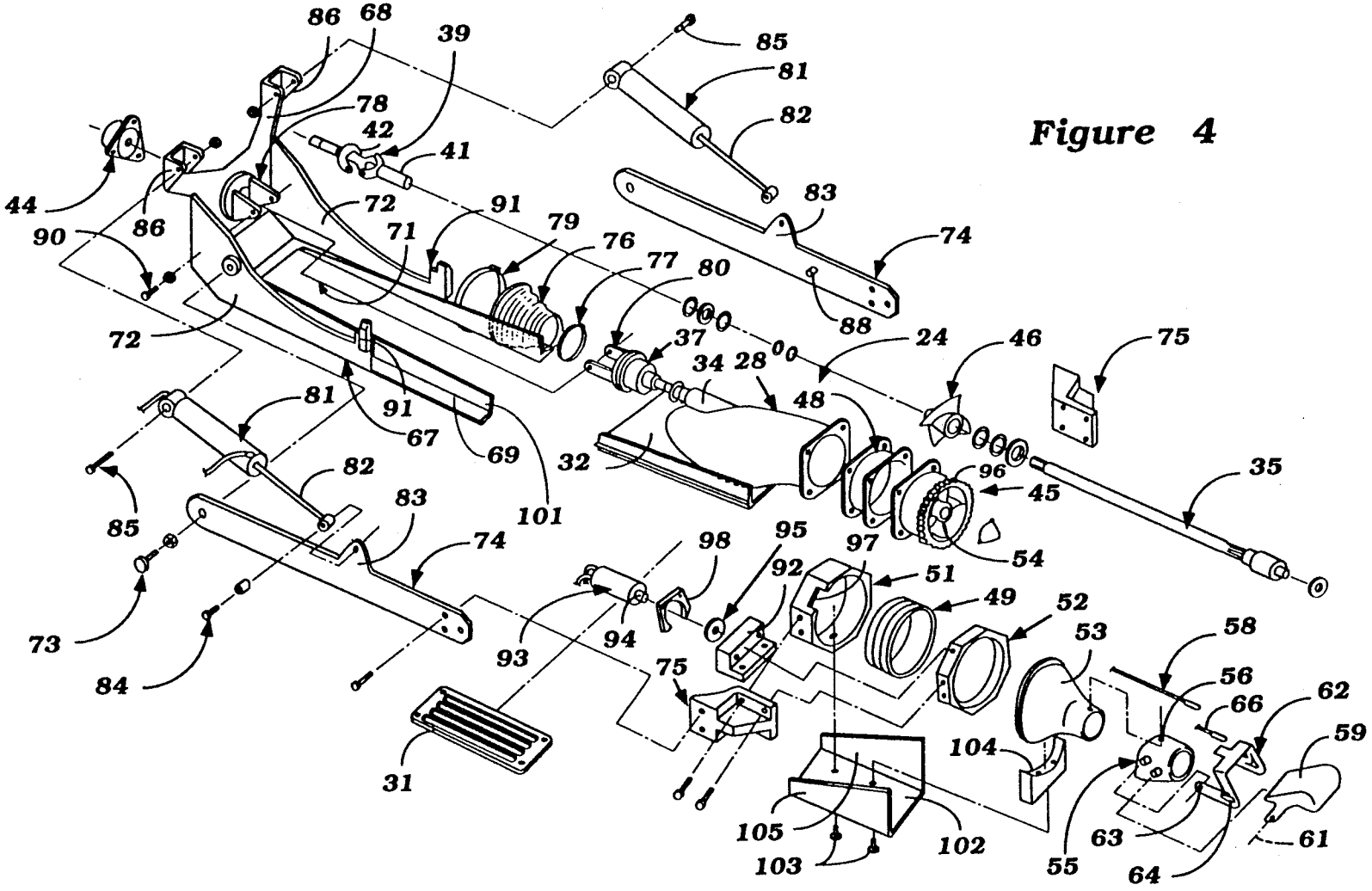
FIG. 4 is an exploded perspective view showing the jet propulsion unit and its mounting arrangement within the watercraft.

The construction by which the jet propulsion unit 24 is mounted within the tunnel 23 will now be described by particular reference to FIGS. 2 through 4. This mounting arrangement includes a cradle assembly, indicated generally by the reference numeral 67 which is affixed in a suitable manner to the rear side of the bulkhead 22 and to which bushing 44 is affixed. The cradle assembly 67, has a generally vertically extending wall 68 that is positioned in confronting relationship to the rear side of the bulkhead 22 and a horizontally extending portion 69 in which an opening 71 is formed which opening registered with the inlet opening 29 of the jet propulsion unit housing portion 28.

The cradle assembly 67 also has a pair of vertically extending side walls 72 that are integrally connected with the front wall 68 and the bottom wall 69 so as to offer reinforcing. In addition, the side walls 72 receive pivot bolts 73 that are aligned with the universal joint 39, for a reason to be described, and which pivotally journal a pair of spaced apart support arms 74 at their forward ends. The support arms 74 are, in turn, affixed at their rear ends to mounting brackets 75 which brackets are affixed by threaded fasteners to the support arm 74 and to the bearing member 51. As a result of this construction, the jet propulsion unit 24 will be pivotally supported by the cradle assembly 67 about a transversly extending horizontal pivot axis defined by the pivot bolts 73.

This pivotal movement is accommodated by the universal joint 39 as aforedescribed. The universal joint 39 is encircled and sealed by means of a flexible boot 76 that is secured to the fitting 37 by means of a clamp 77 and secured to an extending portion 78 of the mounting cradle assembly 67 by means of a clamp 79 so as to provide good water tight sealing for the universal joint 39 while permitting its free rotation and free pivotal movement.

The fitting 37 has a pair of forwardly extending arms 80 that are pivotally connected to a pair of extending arms of the portion 78 of the cradle 72 by means of pivot bolts 90 so as to further provide pivotally support for the jet propulsion unit 24 relative to the cradle assembly 67.

The pivotal movement of the jet propulsion unit 24 about the horizontally disposed transverse axis defined by the pivot bolts 73 and 90 permits movement of the jet propulsion unit 24 from its normal operative position as shown in FIG. 2 to an elevated position as shown in the phantom line view of FIG. 2. This permits the water inlet 29 to be raised out of the body of water in which the watercraft is operating above the normal water level 27 so as to preclude the likelihood of incrustation occurring on the water inlet portion 29.

A power operated device is incorporated so as to pivot the jet propulsion unit 24 about the aforedescribed horizontally extending transverse axis. This power device includes a pair of hydraulicly operated cylinders 81 that have piston rods 82 connected to an extending portion 83 of the supporting arms 74 by means of pivot bolts 84. The cylinders of the units 81 are pivotally connected, by means of pivot bolts 85 to mounting portions 86 formed integrally with the cradle assembly 67 at the upper end of its vertically extending portion 68 on opposite sides thereof. In order to supply fluid under pressure to actuate the fluid cylinders 81, there is provided an electrically driven reversible pump and valve assembly, indicated generally by the reference numeral 87, that is mounted on the forward side of the bulkhead 22 and which is controlled by a suitable remotely positioned controller (not shown).

It should be readily apparent that there are substantial side thrusts generated on the jet propulsion unit 24 when in its operating position and particularly when the steering nozzle 55 is pivoted. The support arms 74 and their rigid connection to the bearing member 51 through the mounting bracket 75 insures a rigid assembly that will take these side thrusts. In addition, the support arms 74 have inwardly extending pin portions (not shown) which are received in complementary recesses formed in upstanding portions 91 of the cradle assembly 67 when the jet propulsion unit 24 is in its normal operative position so as to insure a rigid assembly with minimum likelihood of movement under these forces. In addition and unlike prior art constructions, no pin and slot arrangement is required for controlling the pivotally movement of the jet propulsion unit 24 and, accordingly, an extremely rigid, noise free and strong construction will result.

It should be readily apparent that the pivotal movement of the jet propulsion unit 24 between its normal operative position and its raised out of the water position can be accommodated by flexure of the wire actuators 58 and 66. Their protective sheaths are affixed by means of a fastener or retainer to the mounting bracket 75 at one side of the jet propulsion unit 24 so as to insure against kinking of the transmitters.

In addition to the pivotal movement about the transversely extending horizontal axis, the jet propulsion unit 24 is constructed so that the water inlet portion 28 may be rotated between a downwardly facing position as shown in FIGS. 1, the solid line view of FIG. 2, and an upwardly facing position as shown in the phantom line view of FIG. 2. This brings the water inlet opening 29 in registry with the access opening 26 so that any entrapped foreign material may easily be removed without necessitating removal of the watercraft 11 from the body of water in which the watercraft is operating. It is not necessary to rotate the entire jet propulsion unit 24 but only the water inlet portion 28 thereof. The structure for accomplishing this result is best shown in FIGS. 2 and 4.

It has been previously noted that the impeller housing 45 is mounted within the bearing member 51 for rotation by the bushing 49 and that the impeller housing 45 is affixed to the water inlet portion 28. The bearing member 51 also has mounted to it, by means of a supporting bracket 92, an electric drive motor 93. The electric drive motor 93 has a driven shaft 94 to which is affixed a drive gear 95. The drive gear 95 is enmeshed with a driven ring gear 96 which is formed integrally with the impeller housing 45. This drive gear 95 extends through a notch 97 formed in the bearing member 51 and is enclosed by means of a cover plate 98 so as to provide a driving arrangement between the drive gear 95 and the driven ring gear 96. When the motor 93 is energized, the ring gear 96 will be rotated along with the impeller housing 45 and water inlet portion 28 from a downwardly facing position, as aforenoted, to the upwardly facing service position. When in this position as shown in phantom in FIG. 2, servicing can be possible by permitting clearing of foreign material from the water inlet 29 and specifically from the screen 31. However, since the discharge nozzle 53 and steering nozzle 55 do not rotate, there is no problem with damaging the wire transmitters 58 or 66 or for accommodating such rotary motion at was necessary with the prior art constructions.

The construction of the jet propulsion unit 24 as thus far described may be considered to be substantially the same as that shown in the co-pending application of Noboru Kobayashi and Yoshiki Futaki, entitled "Water Jet Propulsion Unit," Ser. No. 680,709, filed Apr. 4, 1991 and assigned to the assignee hereof and now U.S. Pat. No. 5,151,057. For that reason, reference to that disclosure is incorporated herein by reference and reference may be had to that application for the details of any portions of the construction not herein described.

In conjunction with an important feature of the invention, the cradle 67, in addition to the outer arm 72, has a pair of inwardly disposed upstanding arms 101 which, generally, define the inner periphery of the hull and specifically the water inlet opening 71 which registers with the inlet opening 29 of the jet propulsion unit 24. A combined trim and support member 102 is affixed to the under side of the support ring 51 and the discharge nozzle 53 by means including threaded fasteners 103 and a cradle 104 that bridges the gap between the lower portion of the trim plate 102 and the nozzle 53.

This trim plate 102, therefore, will move up and down about the horizontal axis 73 upon pivotal movement of the jet propulsion unit 24 about this axis. However, the trim plate 102 will not rotate when the inlet portions 28 and impeller potion 45 are rotated. Hence, the plate 104 will only move pivotally about the transverse horizontally extending pivot axis.

The trim plate 102 has a pair of vertically upstanding flanges 105 which are positioned in confronting relationship with the flanges 101 of the cradle 72. As a result, these flanges 105 and 101 will inter-engage and will take any side thrusts that are encountered during the steering movement of the jet propulsion unit.

Figure 7:
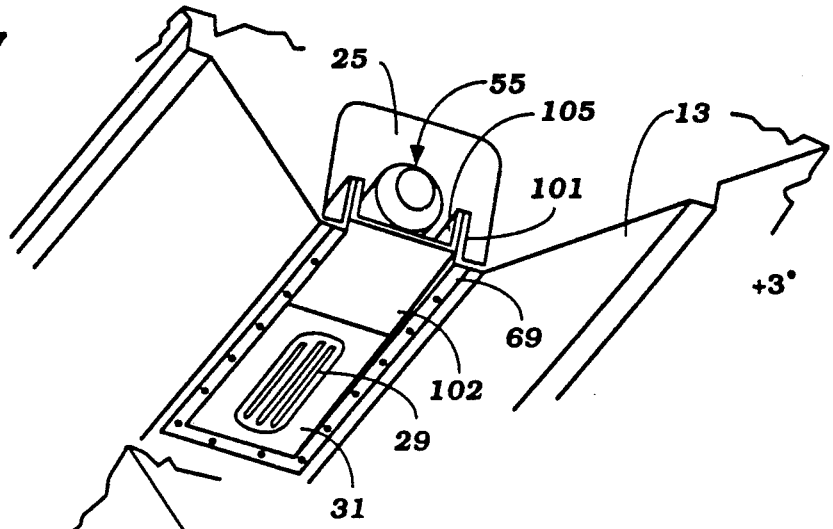
FIGS. 7, 8 and 9 are bottom plan views showing varying trim adjusted positions of the jet propulsion unit and its trim plate.
Figure 8:
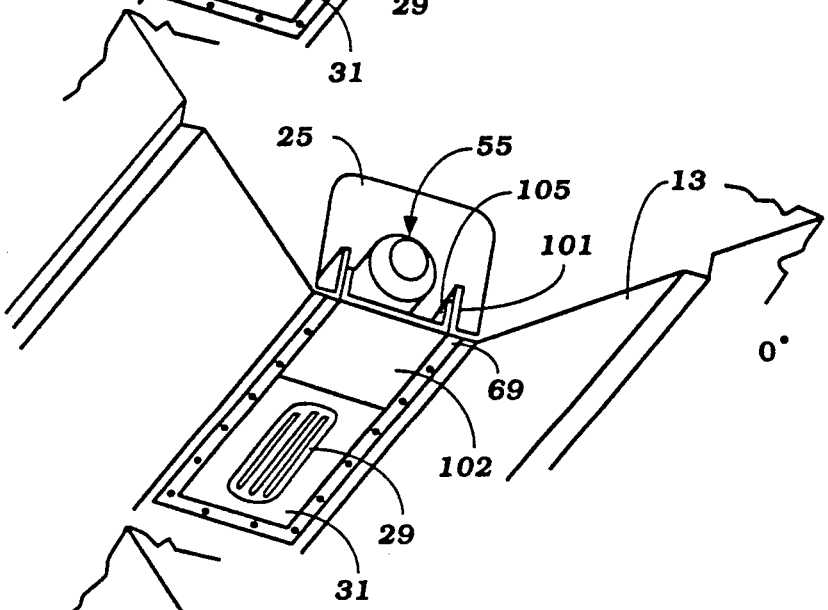
Figure 9:
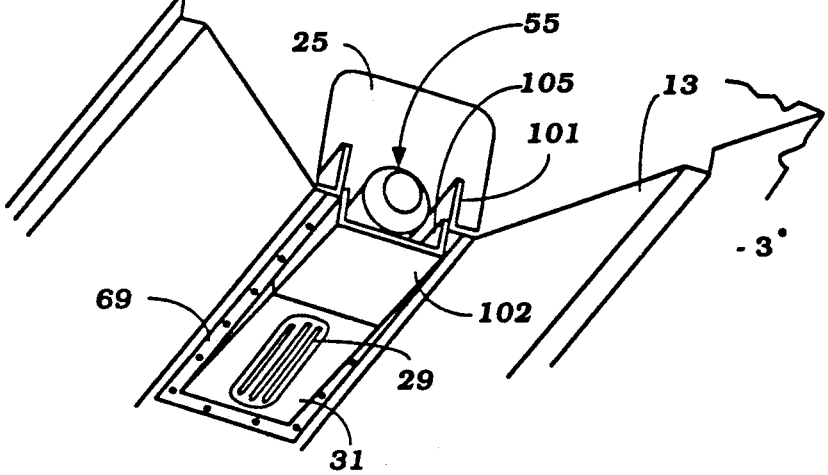
Figure 10:
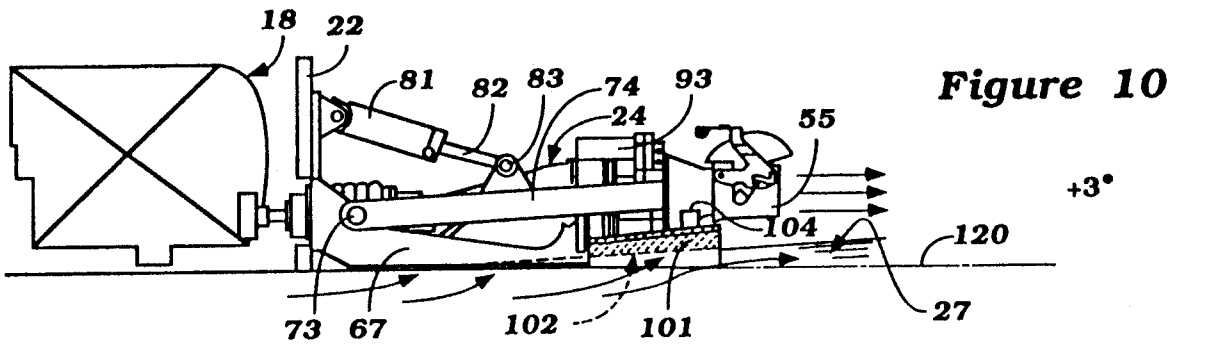
FIGS. 10, 11 and 12 are side elevational views corresponding to the trim adjusted positions of FIGS. 7, 8 and 9 respectively.
Figure 11:
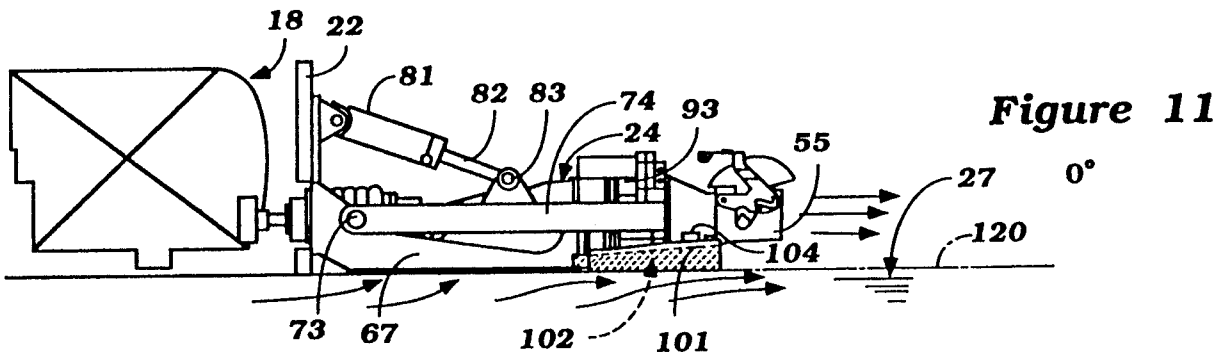
Figure 12:
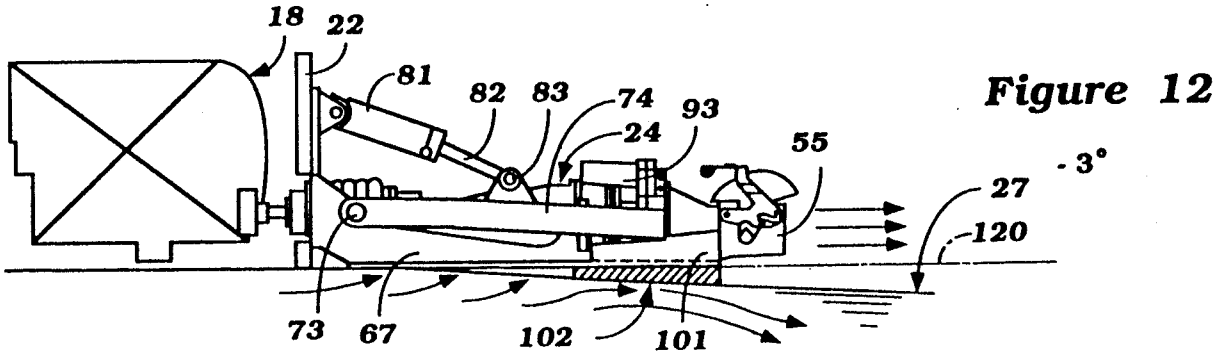

The small angular pivotal movements of the jet propulsion unit 24 and trim plate 102 will permit a trim adjustment of the watercraft by moving the plate 102 upwardly and downwardly between a negative trim condition of about $-3°$ as shown in FIGS. 9 and 12, 0° as shown in FIGS. 8 and 11 and $+3°$ as shown in FIGS. 7 and 10. Therefore, a minor trim adjustment may easily be made in the hull of the watercraft because of this arrangement and, in addition, side thrusts due to steering of the nozzle 55 will also be transferred effectively to the hull and minimize the forces on the jet propulsion unit.

Figure 6:
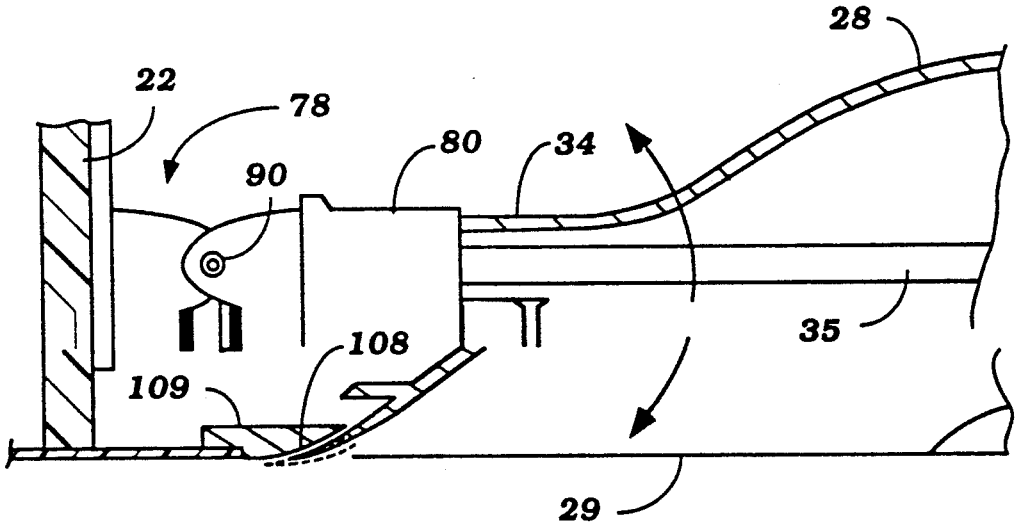
FIG. 6 is a further enlarged side elevational view, in part similar to FIG. 2, with a portion broken away, and shows how the seal between the water inlet opening of the jet propulsion unit and the hull of the watercraft is maintained under trim adjusting conditions.

During these minor trim adjustments, it is desirable to insure that there is good sealing around the water inlet opening 29 of the jet propulsion unit 24. If this is not maintained, the efficiency of the jet propulsion unit can substantially deteriorate due to water leakage. Therefore, a sealing arrangement is provided as best shown in FIGS. 5 and 6. It should be noted that the flange 32 of the jet propulsion unit water inlet portion 28 has upstanding walls 106 which are in confronting relationship with the upstanding portions 101 of the cradle 67. Seals 107, which may be carried by either element, the elements 106 in the illustrated embodiment, provide a good sealing arrangement and hence will insure against water leakage or air leakage that would deteriorate the efficiency of the jet propulsion unit. In addition, the water inlet opening flange portion 32 is also formed with an arcuate surface 108 that cooperates with an arcuate portion 109 extending at the forward ends of the cradle cut out 71. The curvature of the arcuate portions 108 and 109 is about the horizontal transverse pivot axis as aforedescribed and hence, this also insures good efficiency and against water leakage.

It should be readily apparent from the foregoing description that the described construction is extremely effective in permitting the trim of the hull to be adjusted through pivotal movement of the jet propulsion unit 24. In addition, the supporting arrangement takes transverse thrust and will insure against any water leakage around the jet propulsion unit that could deteriorate its efficiency. Of course, the preceding description is that of a preferred embodiment of the invention and various changes and modifications may be made without departing from the spirit and scope of the invention, as defined by the appended claims.

We claim:

1. A jet propelled watercraft comprised of a hull, a jet propulsion unit mounted by said hull for pivotal movement about a horizontally extending transverse pivot axis disposed at the forward end of said jet propulsion unit, a trim plate rigidly affixed to the underside of the rear of said jet propulsion unit and moveable about said transverse pivot axis with said jet propulsion unit, said trim plate extending into the body of water in which the watercraft is operating for adjusting the trim of said watercraft upon pivotal movement of said jet propulsion unit.

2. A jet propelled watercraft as set forth in claim 1 wherein the hull includes a pair spaced apart side walls between which jet propulsion unit is mounted and which side walls are spanned by the trim plate.

3. A jet propelled watercraft as set forth in claim 2 wherein the trim plate has a pair of flange portions engaged with the side walls for taking side thrusts from the jet propulsion unit.

4. A jet propelled watercraft as set forth in claim 3 further including a water inlet opening portion formed in the jet propulsion unit and defined by a pair of flanges engaged with the side walls with seal means interposed therebetween.

5. A jet propelled watercraft as set forth in claim 4 wherein the trim plate is positioned rearwardly of the water inlet opening.

6. A jet propelled watercraft as set forth in claim 5 further including a pair of curved surfaces formed by the hull and the water inlet opening portion of the jet propulsion unit having a radius of curvature about the pivot axis and sealingly engaged during trim pivotal adjustment of the jet propulsion unit.

7. A jet propelled watercraft as set forth in claim 3 wherein the means for pivotally supporting the jet propulsion unit comprises a pair of support arms fixed to the jet propulsion unit and pivotally connected at their forward ends to the hull about the horizontally extending transverse pivot axis.

8. A jet propelled watercraft as set forth in claim 7 further including fluid motor means for pivoting said arms and the jet propulsion unit.

9. A jet propelled watercraft as set forth in claim 2 wherein the side walls define at least in part a tunnel in which the jet propulsion unit is at least partially mounted.

10. A jet propelled watercraft as set forth in claim 1 wherein the jet propulsion unit includes a downwardly facing water inlet portion defining a water inlet opening through which water may be drawn and means for rotating said water inlet portion about a longitudinally extending axis so that said water inlet opening can be rotated from a downwardly facing position to an upward position.

11. A jet propelled watercraft as set forth in claim 10 wherein the trim plate is affixed to a portion of the jet propulsion unit which does not rotate about the longitudinally extending axis.

12. A jet propelled water craft as set forth in claim 11 further including a pair of curved surfaces formed by the hull and the water inlet portion of the jet propulsion unit having a radius of curvature about the pivot axis and sealingly engaged during trim pivotal adjustment of the jet propulsion unit.

13. A jet propelled watercraft as set forth in claim 10 wherein the trim plate is positioned rearwardly of the water inlet opening.

14. A jet propelled watercraft comprising a hull having a transversely extending horizontal portion, a jet propulsion unit mounted by said hull for pivotal movement about a horizontally extending transverse axis disposed at the forward portion of said jet propulsion unit, said jet propulsion unit having a water inlet opening defined by an outwardly extending flange thereof and having a transversely extending horizontal portion, said horizontal portions of said jet propulsion unit water inlet opening and of said hull being curved about the axis of pivotal movement and sealingly engaged upon trim adjustment of the jet propulsion unit.

15. A jet propelled watercraft as set forth in claim 14 wherein the transversely extending horizontal portion of the hull is defined at a forward portion of a tunnel formed in the underside of the hull and wherein the transversely extending portion defines in part a downwardly facing opening.

16. A jet propelled watercraft as set forth in claim 15 wherein the tunnel is further defined by a pair of side walls and further including a pair of side flanges on said water inlet opening engaged with said side walls with seal means interposed therebetween.

17. A jet propelled watercraft comprised of a hull, a pair of spaced apart side walls, a jet propulsion unit having an outer housing spaced inwardly of said side walls and mounted by said hull for pivotal movement about a horizontally extending transverse axis disposed at the forward portion of said jet propulsion unit, and means forming a pair of thrust surfaces fixed against movement relative to the jet propulsion unit outer housing and pivotal as a unit with said jet propulsion unit and engaged with said side walls for transferring side thrust from the jet propulsion unit to the hull.

18. A jet propelled water craft as set forth in claim 17 wherein the thrust surfaces of the jet propulsion unit are positioned rearwardly of its water inlet opening.

19. A jet propelled watercraft as set forth in claim 17 wherein the pair of spaced apart side walls defined in part a tunnel formed in the underside of the hull and wherein the jet propulsion unit is mounted at least in part in the tunnel.

* * * * *